United States Patent [19]

Duenes et al.

[11] Patent Number: 4,831,833

[45] Date of Patent: May 23, 1989

[54] FROST DETECTION SYSTEM FOR REFRIGERATION APPARATUS

[75] Inventors: Patricia Dueñes; Richard L. Kenyon, both of Irvine, Calif.; John N. Scapes, Schamburg, Ill.; Eugene H. Schild, Des Plaines, Ill.; Arthur P. Strong, Prospect Heights, Ill.

[73] Assignee: Parker Hannifin Corporation, Cleveland, Ohio

[21] Appl. No.: 72,330

[22] Filed: Jul. 13, 1987

[51] Int. Cl.[4] ..... F25D 21/02

[52] U.S. Cl. ..... 62/140; 62/158

[58] Field of Search ..... 62/140, 151, 156, 80, 62/155, 234, 157, 158; 364/551, 557; 73/861.61, 861.48

[56] References Cited

U.S. PATENT DOCUMENTS

| | | | |
|---|---|---|---|
| 1,058,092 | 4/1913 | Pew et al. | 73/861.61 X |
| 2,597,729 | 5/1952 | Homeyer | 62/140 |
| 3,004,399 | 10/1961 | Keller | 62/140 |
| 3,359,749 | 12/1967 | Howland et al. | 62/140 |
| 3,362,183 | 1/1968 | Sutton, Jr. | 62/140 |
| 3,377,817 | 4/1968 | Petranek | 62/140 |
| 4,045,971 | 9/1977 | Brenner, Jr. | 62/140 |
| 4,123,792 | 10/1978 | Gephart et al. | 361/30 |
| 4,232,528 | 11/1980 | Behr | 62/140 |
| 4,381,549 | 4/1983 | Stamp, Jr. et al. | 364/551 X |
| 4,388,691 | 6/1983 | Nuspl | 73/861.48 X |
| 4,400,949 | 8/1983 | Kinoshita et al. | 62/140 |
| 4,439,997 | 4/1984 | Cantley | 62/228.3 X |
| 4,538,420 | 9/1985 | Nelson | 62/140 |

FOREIGN PATENT DOCUMENTS

| | | | |
|---|---|---|---|
| 0118549 | 9/1980 | Japan | 62/140 |
| 0023656 | 3/1981 | Japan | 62/140 |

*Primary Examiner*—Harry B. Tanner

*Attorney, Agent, or Firm*—Ralph E. Jocke

[57] ABSTRACT

Apparatus for detecting frost buildup on an evaporator (34) of a refrigeration system (10) includes an air velocity sensor (42) in the air flow path. The sensor is connected to an analog to digital converter (46) which delivers binary signals representative of air velocity to a microcomputer (50) which includes a processor and a memory. Microcomputer (50) is programmed to prompt an operator through a screen (56) at a user station (52) to input an air flow reduction factor at a keyboard (54). The microcomputer uses the air flow reduction factor and the velocity sensed when the evaporator is fully defrosted to calculate a defrost initiation value. When the air velocity sensed at the sensor is no longer greater than the initiation value the microcomputer generates a defrost initiation signal. The microcomputer also includes a timer clock and periodically prints at a printer (58) the time and the velocity sensed.

8 Claims, 4 Drawing Sheets

| 112 ROOM TEMP (F) | 116 AIRVEL FT/MIN ##### | 118 DFRST AIRVEL FT/MIN | 120 NO ICE AIRVEL FT/MIN | 114 EVAP PRESS (PSIG) |
|---|---|---|---|---|
| 122 SEP 22 14/37/06 TEMPERATURE CONTROL | | | | |
| -11.3 | 763.6 | 731.6 | 885.2 | 0 |
| SEP 22 14/44/45 TEMPERATURE CONTROL | | | | |
| -11.3 | 776.4 | 731.6 | 885.2 | 0 |
| SEP 22 14/53/30 TEMPERATURE CONTROL | | | | |
| -10.9 | 763.6 | 731.6 | 885.2 | 0 |
| 122 SEP 22 15/02/18 TEMPERATURE CONTROL | | | | |
| -10.9 | 757.2 | 731.6 | 885.2 | 0 |
| SEP 22 15/11/04 TEMPERATURE CONTROL | | | | |
| -11.1 | 738 | 731.6 | 885.2 | 0 |
| 122 SEP 22 15/13/18 ACTIVE DEFROST | | | | |
| -11.1 | 494.8 | 731.6 | 885.2 | 0 |
| SEP 22 15/15/34 ACTIVE DEFROST | | | | |
| -10.7 | 14.8 | 731.6 | 885.2 | 40.6 |
| SEP 22 15/17/41 ACTIVE DEFROST | | | | |
| -10.2 | 21.2 | 731.6 | 885.2 | 62.1 |
| 122 SEP 22 15/19/56 ACTIVE DEFROST | | | | |
| -10 | 14.8 | 731.6 | 885.2 | 68.9 |
| SEP 22 15/22/02 ACTIVE DEFROST | | | | |
| -9.8 | 2 | 731.6 | 885.2 | 68.9 |

FIG. 4

FROST DETECTION SYSTEM FOR REFRIGERATION APPARATUS

BACKGROUND OF THE INVENTION

1. Technical Field

This invention relates to refrigeration systems. Specifically this invention relates to systems for detecting an accumulation of frost on an evaporator and initiating a defrost cycle when the accumulation of frost is excessive.

2. Background Art

Conventional refrigeration systems achieve cooling by allowing a refrigerant such as ammonia or a fluorocarbon material to expand in the coils of an evaporator. As the refrigerant expands it absorbs heat from the surroundings. A fan or other air moving device is used to draw air through the evaporator so heat is more effectively removed from the air in the refrigerated space.

As the temperature in the evaporator is generally below the freezing point of water, water vapor in the air often condenses on the evaporator and solidifies as frost. The buildup of frost adversely effects the cooling efficiency of the evaporator due to two cooperating factors. First, frost is a thermal insulator. The thicker the frost layer on the evaporator coils, the less efficient the heat transfer between the air and the evaporator. In addition, the buildup of frost restricts the air flow through the evaporator coils. As a result, less air is cooled. Eventually, as frost builds up, the combined effects of reduced air flow and less heat transfer require that the evaporator be defrosted to restore cooling efficiency.

In prior systems evaporators have been defrosted automatically and periodically under timed control. The time between the defrost cycles is set by an operator based on their experience with the system. The problem with such timed systems is that the amount of water vapor in the air in the cool area varies depending on a number of factors. Some of these factors include the humidity in the environment surrounding the space being cooled, the number of times the access door to the cooled area is opened, and the duration of such openings. The temperature in the cooled area, the temperature of the evaporator, the velocity of the air passing through the evaporator and the evaporation of water from items stored in the cooled area also effect the rate of frost buildup. Usually timed defrost systems must be set for the most severe frost accumulation conditions. This leads to unnecessary defrost cycles which waste energy and cost money.

Several prior systems have been used for detecting the buildup of frost on the coils of evaporators so that defrost cycles are initiated only when the buildup is large enough to adversely impact the cooling efficiency of the refrigeration system. In U.S. Pat. No. 4,123,792 a system is described which measures the power consumed by an electric fan motor which draws air over the evaporator. The principle of operation of this system is that frost buildup on the evaporator impedes air flow. As frost builds the motor works harder to drive the fan and when a particular set point is reached a defrost cycle is initiated. The problem with such a system is that factors other than frost buildup also impact the power requirements for a fan motor. Such factors include the supply voltage, the temperature in the cooled space and the age of the motor. Other systems such as that shown in U.S. Pat. No. 4,400,949 have employed similar principles but have attempted to compensate for some of the factors which may give false frost buildup indications. The system disclosed in this patent monitors other parameters in an attempt to determine if factors other than frost buildup are causing increased power consumption. This system is complex and expensive to implement. It also has the disadvantage that the characteristics of refrigeration system components vary with age and loss of refrigerant. Such a system cannot compensate for these factors.

Other frost detection systems such as those shown in U.S. Pat. Nos. 4,045,971 and 4,232,528, employ photoelectric sensors to detect the level of frost buildup on an evaporator coil. The problem with photoelectric sensors is that they are only capable of sensing frost at a particular location on an evaporator. As frost buildup is not always regular or uniform, frost may build at locations away from the photo sensor and not be detected. This will cause the evaporator to operate inefficiently because defrosting is needed. In other situations frost may build up near the sensor to a greater extent than at other locations causing defrost to be initiated when it is not needed. Another deficiency of such systems is that they may not detect the buildup of transparent, clear ice.

Another prior art system manufactured by Levy Systems of Campbell, California, senses the differences in air temperature on each side of the evaporator in the refrigerated space as well as the temperature of the refrigerant leaving the evaporator. The data from the sensors is processed to determine if there is a frost buildup. The problem with the Levy system is that it is complex and that changes in temperature across the evaporator indicative of frost buildup may occur in other situations as well. In addition, this system cannot compensate for changes that occur with age or loss of refrigerant.

Thus, there exists a need for a frost detection system that is more accurate, reliable and less expensive to implement than existing systems and which is unaffected by changes in the system due to changes in system components.

DISCLOSURE OF INVENTION

It is an object of the present invention to provide a frost detection system for an evaporator which senses frost buildup monitoring air velocity adjacent said evaporator.

It is a further object of the present invention to provide a frost detection system which is unaffected by temperature in the refrigerated area.

It is a further object of the present invention to provide a frost detection system that is unaffected by changes in the operating characteristics of the refrigeration equipment due to aging.

It is a further object of the present invention to provide a frost detection system that is more accurate, reliable and less expensive to implement that existing systems.

Further objects of the present invention will be made apparent in the following best modes for carrying out the invention and the appended claims.

The foregoing objects are accomplished by a system for monitoring frost buildup on an evaporator of a refrigeration system which can be used to initiate a defrost cycle when the frost buildup reaches a predetermined amount. Air is pulled through the evaporator by a fan. An air velocity sensor is mounted in the air flow path in advance of the evaporator. The velocity sensor produces an output in relation to air velocity. The sensor is connected through an analog to digital converter to a computer processor which includes a memory. The computer is programmed to calculate air velocity from the signals generated at the sensor. An operator of the system also programs the processor with an air flow reduction factor representative of an amount of reduction in air flow associated with unacceptable frost buildup. The air flow reduction factor is stored in the memory of the computer.

The processor is programmed to calculate a defrost initiation value from the air velocity sensed when the evaporator is in the fully defrosted condition and the air flow reduction factor. The processor periodically samples the signals coming from the sensor and calculates the air velocity. The air velocity adjacent the evaporator is compared by the processor to the defrost initiation value. When frost buildup on the evaporator causes the air velocity to no longer exceed the initiation value the processor generates a defrost cycle initiation signal which causes the refrigeration system to execute a defrost cycle.

After completion of the defrost cycle, refrigeration begins again. The air flow reduction factor stored in the memory and the initial air velocity adjacent the evaporator after the defrost cycle are used to calculate a new defrost initiation value. This new value reflects the then current maximum air velocity achievable for the system components. The refrigeration cycle continues until the velocity sensed falls below the new initiation value due to frost buildup and the process is again repeated.

BRIEF DESCRIPTION OF DRAWINGS

FIG. 4 is a computer printout representative of that generated by the system during operation.

BEST MODES FOR CARRYING OUT INVENTION

Figure 1:
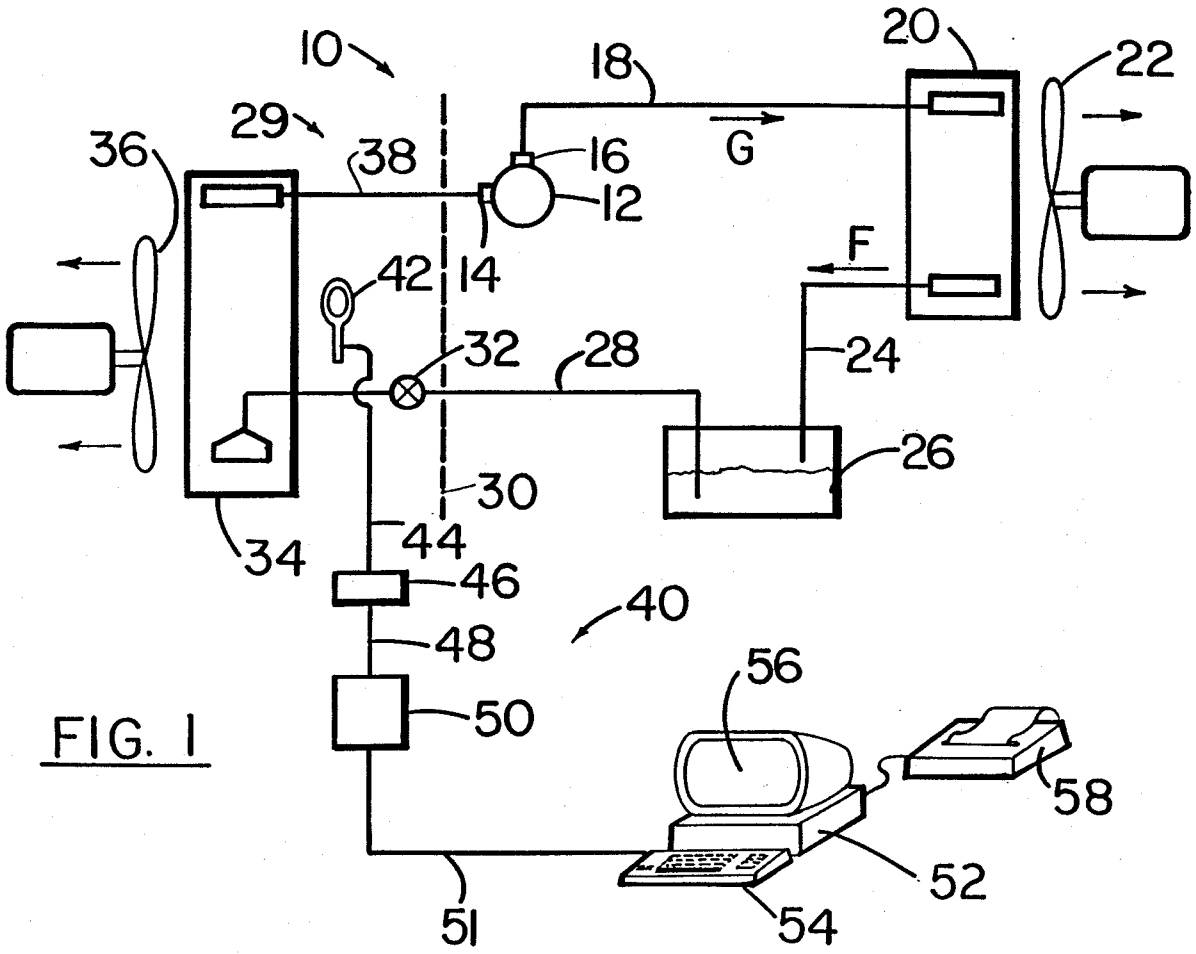
FIG. 1 is a schematic view of the preferred form of frost detection system of the present invention.

Referring now to the drawings and specifically to FIG. 1, there is shown therein a schematic of a refrigeration system generally indicated 10. System 10 is of the type employing ammonia or a fluorocarbon material as a refrigerant and includes a compressor 12 having an inlet 14 and a discharge 16. Compressor 12 receives refrigerant vapor at low pressure at inlet 14 and discharges the vapor at a higher pressure at discharge 16. The refrigerant vapor is then moved through a line 18 in the direction of arrow G to a condenser 20. The vapor passes through a plurality of coils in condenser 20. Air is drawn across the coils of the condenser by a fan 22. The air removes heat from the vapor and causes it to condense to a liquid.

The liquid refrigerant leaves condenser 20 in a line 24 and flows in the direction of arrow L. Line 24 terminates in a receiver 26. Refrigerant in the liquid form is discharged from receiver 26 through a line 28. Line 28 passes into the space to be cooled by the refrigeration system generally indicated 29. Area 29 is shown separated from the surrounding environment by a dashed line 30.

Line 28 terminates at an expansion valve 32. Expansion valve 32 is connected to an evaporator 34. The evaporator contains a plurality of coils. As the refrigerant passes through these coils it absorbs heat. The absorption of heat causes the refrigerant to change from a liquid to a vapor. A fan 36 draws air over the coils of the evaporator in the direction of arrow F which facilitates removal of heat from the air in cooled space 29. The fan is cycled on and off during refrigeration under control of a thermostat to regulate the temperature in the cooled space. Refrigerant vapor is discharged from evaporator 34 in a line 38 which returns the vapor to inlet 14 of compressor 12.

It will be understood by those skilled in the art that system 10 is a schematic which sets forth in a basic direct expansion system the fundamental operating devices and principles of the system. An actual refrigeration system may include additional components such as valves, regulators, controllers and accumulators. Applicant's invention may also be used with other basic system types such as liquid overfeed or flooded systems.

The preferred form of the frost detection system of the present invention is shown in FIG. 1 and generally indicated 40. System 40 includes an air velocity sensor 42. Sensor 42 is mounted in cooled space 29 and in the air flow path through evaporator 34. In the preferred form of the invention, sensor 42 is a model AVS600-04-S4 air velocity sensor manufactured by Sierra Instruments Inc. of Carmel Valley, Calif. Although many types of sensors may be successfully used in other embodiments, sensors of the preferred type are heated resistance temperature detectors which produce outputs proportional to the rate of heat transfer off a heated element. Sensor 42 is mounted adjacent evaporator 34 and in the preferred embodiment is on the side opposite fan 36 near the central area of the evaporator which assures a uniform flow past the sensor representative of the overall flow through the evaporator. The Sierra Instruments sensor incorporates a signal conditioner which gives an output current which varies linearly with air flow velocity in the range from 0 to 1000 SCFM.

Sensor 42 is connected by a cable 44 to an interface 46. Interface 46 serves as analog to digital converter means for converting the current signal generated by sensor 42 to a binary signal. Interface 46 in the preferred embodiment is a Model AD0809CCN converter and multiplexer manufactured by National Semiconductor Corporation.

Interface 46 is connected by a data line 48 to a microcomputer processor 50. Microcomputer 50 includes a non-volatile RAM memory. Microcomputer 50 is connected by a cable 51 to a user station 52. In the preferred form of the invention user station 52 is an Apple IIe personal computer which includes a keyboard 54 which serves as input means, a screen 56 and a printer 58. In many embodiments a user station that has independent processing and storage capability will not be required. However, such a station is desirable where the operation of several refrigeration systems are to be controlled and monitored from a single user station.

Microcomputer 50 is programmed to execute a series of steps. In some embodiments the microcomputer stores particular values and quantities as well as executes program steps as later explained. Microcomputer 50 is also programmed to time average the signals originating at sensor 42 to eliminate "noise" caused by turbulence and irregularities in the air flow. This low pass filtering calculation provides a representative air velocity signal which can be used for evaluation. Because of the large processing capability associated with a single microcomputer, in some embodiments of the invention it is possible to use the microcomputer to control several aspects of the refrigeration system in addition to monitoring frost buildup. In such embodiments the microcomputer processor would have to execute further steps in addition to those described herein. However, as control of other aspects of a refrigeration system do not form a part of the present invention such aspects are not discussed in detail.

Figure 2:
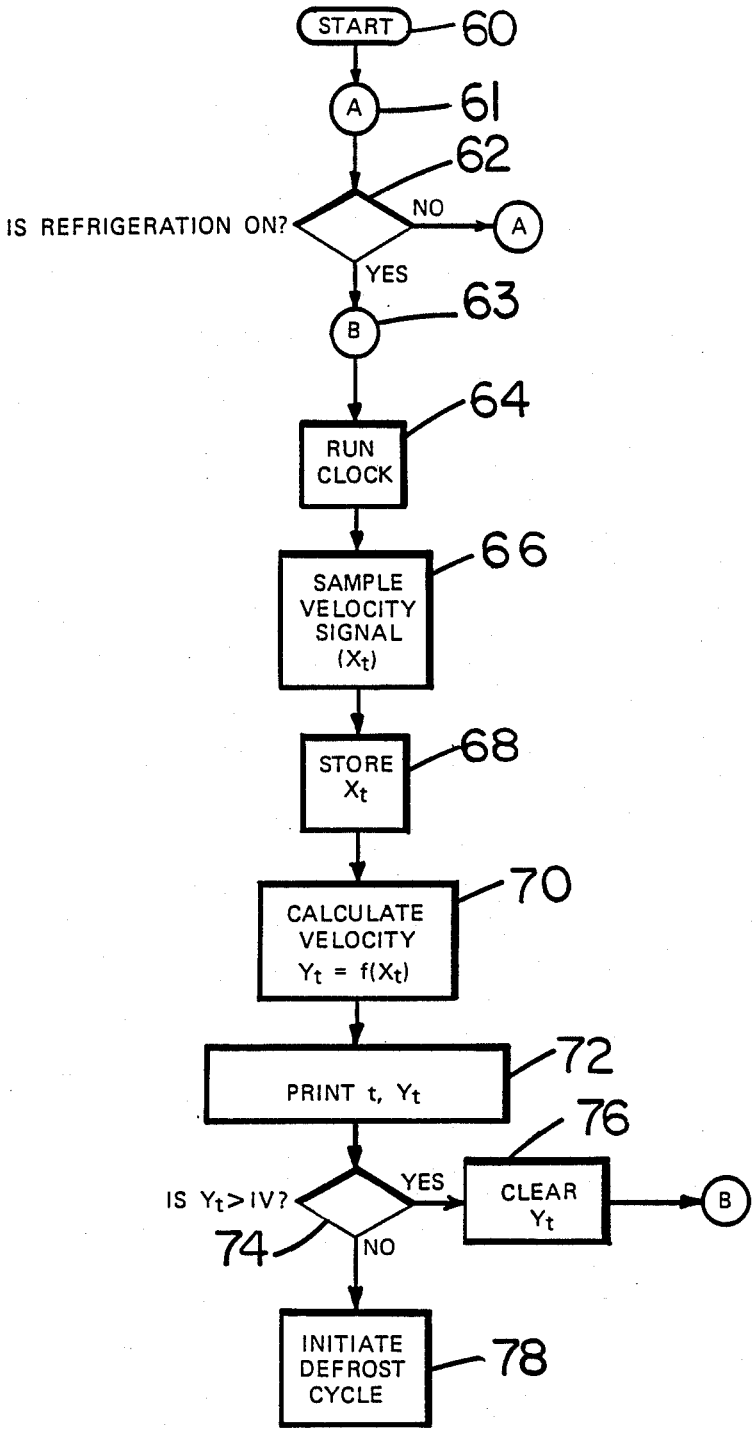
FIG. 2 is a flow chart of a first computer program executed by the processor of the present invention.

FIG. 2 is a flow chart of program steps executed by microcomputer 50 for a first operating sequence. According to the flow chart of FIG. 2, the microcomputer 50 operates to initiate a defrost signal when the velocity of the air passing through evaporator 34 decreases to a predetermined value due to frost buildup. This predetermined velocity is designated the defrost initiation value ("IV") and is stored in the memory associated with the microcomputer. The program begins from a start point 60 and can be initiated by an event such as supplying a signal to the processor in the microcomputer. The program next executes a decision step 62 to determine if the refrigeration system is operating in a refrigeration mode. This decision can be made from a number of parameters such as the conditions of the valves in system 10 and whether or not fan 22 is operating. If refrigeration is not occurring, then the refrigeration system may be off or in the defrost cycle and there is no need to test for frost buildup. For this condition decision step 62 returns the program to point 61 and waits for the refrigeration cycle to begin.

When refrigeration begins, decision point 62 directs the program to run a timer clock routine 64 which is used to control periodic sampling of the air flow velocity carried out by the program as later explained. The clock can also function as an elapsed timer to keep track of the time period between defrost cycles. Clock routine 64 could also be a real time clock that is continuously operated. Clock routine 64 waits a sufficient time after the fan first starts to allow the air flow to stabilize and thereafter periodically causes sampling routine 66 to accept the filtered velocity signal originating at sensor 42 known as "Xt". The program next executes step 68 which stores Xt in the memory. The program uses Xt in routine 70 to calculate air velocity "Yt" which is a function of Xt. The program then executes step 72 which causes printer 58 to print Yt and a time factor "t" based on the condition of clock routine 64. This allows an operator to monitor how the air velocity (and thus frost buildup) is changing with time.

In the program described in FIG. 2, the level of air flow velocity IV which indicates that air flow through evaporator 34 is sufficiently restricted by frost to require initiation of a defrost cycle, is a fixed value stored in the memory associated with microcomputer 50. In decision step 74 the program operates to compare the value of IV to the air flow velocity Yt passing the sensor. If Yt is greater than IV the amount of frost on the evaporator is less than that required to initiate defrost and the system executes step 76 which clears the sensed velocity and returns the program to point 63 causing a repetition of the sampling process.

The program steps in FIG. 2 cause the system to repeat the sampling cycle until velocity Yt is no longer greater than predetermined value IV. This condition results when the frost on evaporator 34 builds up to reduce the air flow past probe 42 to a sufficient degree. In this condition the decision point 74 directs the processor to generate a defrost initiation signal and initiate a defrost routine 78. Routine 78 may do several things such as modify the flow of refrigerant through the refrigeration system 10 so as to apply warm refrigerant to evaporator 34 for sufficient time to melt the frost. After completion of the defrost cycle the refrigeration cycle begins again and processor 50 repeats its programmed steps.

The flow chart shown in FIG. 2 is satisfactory for use with systems that have uniform, well defined air velocity characteristics through their evaporators. This allows the defrost initiation value to be a known quantity which can be programmed into the memory of the microcomputer. In other systems this is not possible because the air flow velocities will vary depending on where the probe is mounted. In addition the flow velocity through the evaporator when it is fully defrosted will vary due to aging of the fan blades and motor, the temperature in the refrigerated area and the buildup of dirt on the evaporator.

Figure 3:
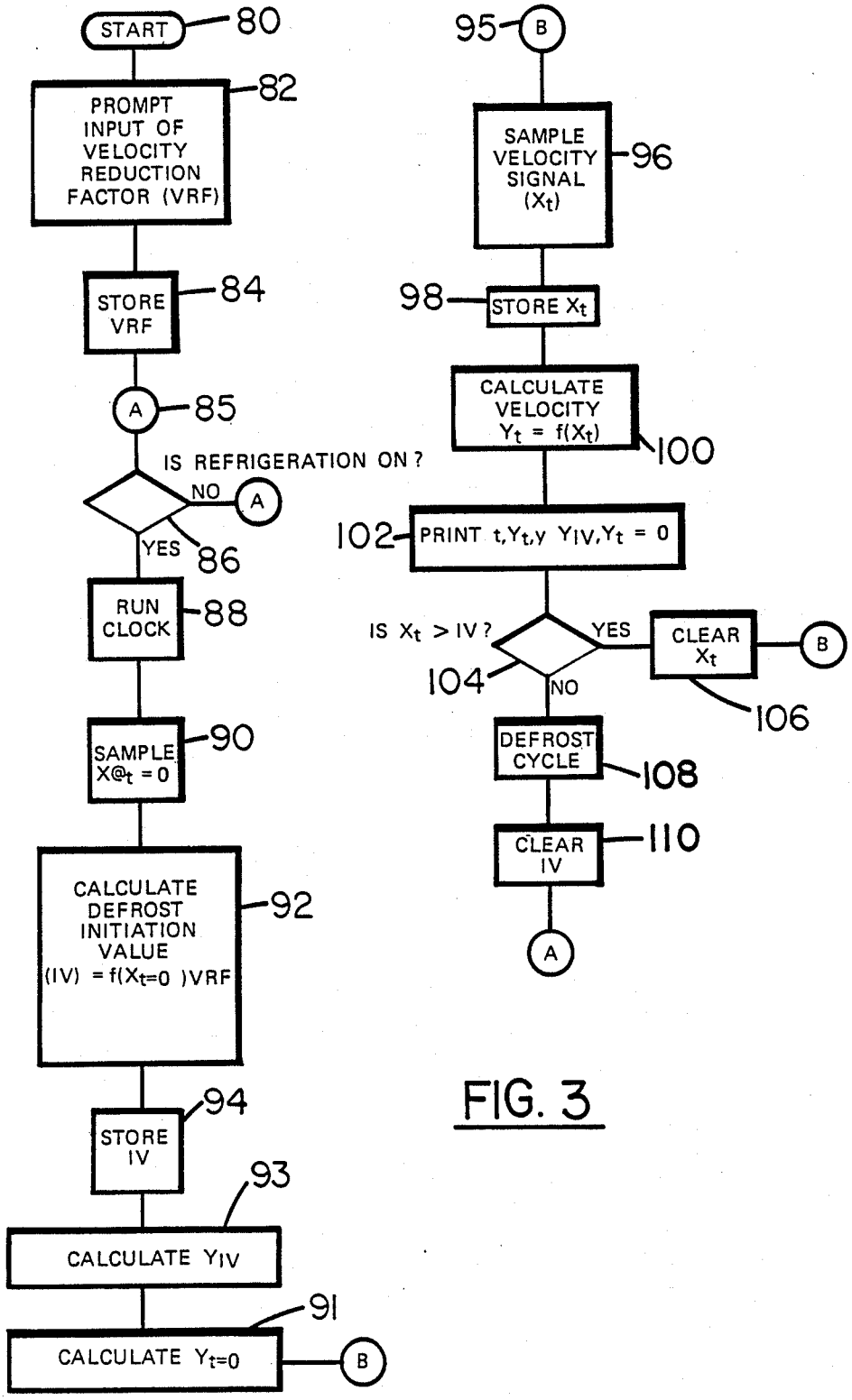
FIG. 3 is a flow chart of a second computer program executed by the processor of the present invention.

FIG. 3 is a flow chart of an alternative program which may be executed by microcomputer 50 when it is desired to have a frost sensing system that is self-adapting to different evaporator configurations and to changes that occur due to aging of a refrigeration system. The program begins from a start point 80 and may be initiated in response to an event such as a signal to the processor of the microcomputer. Next the program executes a routine 82 which sends a message to the operator through screen 56 of user station 52, directing them to input a velocity reduction factor ("VRF"). In this alternative embodiment of the program, the VRF is a percentage of the original air velocity through evaporator 34 when it is defrosted. This represents the percentage of the original air flow that must be maintained to have effective refrigeration. Applicants have successfully used 80 percent as the VRF. Those skilled in the art will understand that in other embodiments, routine 82 may be deleted and the VRF may be permanently stored in the memory associated with the microcomputer rather than being input by an operator.

In response to routine 82 displaying a message to the operator, the operator inputs a VRF value using input means, keyboard 54 at user station 52. The VRF input by the operator is stored at step 84 in the memory of the microcomputer for later use. The microcomputer then executes a decision step 86 to determine if system 10 is operating in the refrigeration cycle and the fan is on. If the refrigeration cycle and fan are not on, the program returns to point 85 to wait for refrigeration to begin.

Once the refrigeration cycle begins, decision step 86 actuates a timer clock routine 88 which controls a sampling operation as later explained. At the beginning of the cycle with the evaporator in the fully defrosted condition, processor 50 executes step 90 to sample the air velocity at probe 42 once the fan has started and sufficient time has elapsed for the flow to stabilize. In a step 92 the initial flow rate is multiplied by the VRF to determine a defrost initiation value IV which is representative of the restricted flow velocity at which a defrost initiation signal will be generated. The value of IV is stored for future use in step 94. The actual air velocity which will exist at the initiation point ("Yiv") is calculated in a step 93 and the air velocity for the fully defrosted condition ("YtO") is calculated at step 91. Although it is not shown in the flow chart, these quantities are also stored in the memory of the microcomputer for later use.

It should be noted that the signal ("X") coming from the probe is linearly proportional in the preferred embodiment to the air velocity and it is not necessary for microcomputer 50 to calculate IV as a flow velocity. Rather IV is stored in the memory as a percentage of the initial value of X.

Step 96 is then executed to sample X for the then existing flow velocity. This quantity "Xt" is stored in the memory in step 98 for later use. Step 100 of the program calculates the actual flow rate at sensor 42 "Yt" from the then existing signal Xt. The then current flow rate is printed at printer 58 by step 102 of the program. In addition to the current air velocity, the time, original velocity for the fully defrosted condition, and the velocity at which defrosting will be initiated are also printed at step 102 (see FIG. 4). This information is made available at user station 52 to assist the operator in monitoring the operation of the system.

Decision step 104 compares the existing value of Xt to IV. As long as Xt remains greater than IV, the flow velocity is above that at which the user has elected to have a defrost cycle occur. In this condition step 106 is executed which clears Xt and directs the program to point 95. This causes the program to again sample Xt.

When Xt is no longer greater than IV decision step 104 causes a defrost initiation signal to be generated and causes microcomputer 50 to execute a routine 108 which defrosts the evaporator. After the frost is removed from the evaporator, step 110 is executed. Step 110 deletes the value of IV which was used to initiate the last defrost cycle and the program then returns to a point 85. As refrigeration begins a new value of IV will be calculated using the stored VRF value and the then current value of X reflecting the flow rate through the fully defrosted evaporator. Thus, it does not matter if the flow characteristics have changed slightly from the last cycle, the next defrost cycle will be initiated when flow velocity is reduced to the VRF percentage of the original velocity.

FIG. 4 is a representative printout generated at printer 58 during operation of the program shown in FIG. 3. The printout includes a first column 112 which gives the temperature in cooled space 29. The printout also has a last column 114 which indicates the pressure in the evaporator. The information in columns 112 and 114 is delivered to the printer from sensors that are not a part of the frost detection system of the present invention. A second column 116 is the air flow velocity existing at sensor 42, value Yt calculated by microcomputer 50. Third column 118 is the defrost initiation value Yiv. As shown in FIG. 4, when the actual velocity Yt falls belows the value in column 118, the defrost cycle is initiated. Fourth column 120 shows the value of the air flow velocity for the fully defrosted condition of the evaporator YtO. Each printout entry 122 also includes the date and time that the data is sampled. This is achieved by running the system clock in microcomputer 50 in real time to show a timed relationship between each entry. Entries 122 also indicate whether the refrigeration system is in "temperature control", that is, in a refrigeration cycle, or is in a defrost cycle. Those skilled in the art will understand that the system may be modified to display other parameters such as values of X which may be of interest to the user.

Thus, the new frost detection system achieves the above stated objectives, eliminates difficulties encountered in the use of prior devices, solves problems and obtains the desirable results described herein.

In the foregoing description certain items have been used for brevity, clarity and understanding. However, no unnecessary limitations are to be implied therefrom because such terms are for descriptive purposes and intended to be broadly construed. Moreover, the descriptions and illustrations are by way of examples and the invention is not limited to the details shown or described.

Having described the features, discoveries and principles of the invention, the manner in which it is constructed and operated and the advantages and useful results obtained, the new and useful structures, devices, elements, arrangements, parts, calculations, systems, equipment operations and relationships are set forth in the appended claims.

We claim:

1. A system for detecting frost buildup on an evaporator of a refrigeration system having intermittent forced air flow across the evaporator, and for avoiding unnecessary defrost cycles due to transient fluctuations in air flow, comprising:

air movement means for moving air across said evaporator, said air movement means operative intermittently;

air velocity sensing means for sensing air velocity adjacent the evaporator;

signal generating means in connection with said sensing means for generating at least one signal corresponding to the air velocity sensed by said sensing means;

processor means in connection with said signal generating means, and said air movement means;

memory means in connection with said processor means, said memory means adapted for storing a defrost initiation value;

said processor means programmed to receive said air velocity signal, to calculate said defrost initiation value as a function of said air velocity signal a predetermined time after said air movement means commences operation and when said evaporator is in a defrosted condition, and to transmit said defrost initiation value to said memory means for storage therein, said processor means further programmed to thereafter compare said velocity signal and said initiation value and generate a defrost cycle initiation signal when said velocity signal and said initiation value have a predetermined relationship.

2. The apparatus according to claim 1 wherein the air velocity sensing means is a heated resistance temperature detector.

3. The apparatus according to claim 2 wherein the signal generating means includes analog to digital signal converter means for converting analog signals from the detector to binary signals.

4. The apparatus according to claim 3 wherein said processor means and memory means are portions of a microcomputer.

5. The apparatus according to claim 4 wherein said memory means is a non-volatile random access memory and said defrost initiation value is stored in said memory.

6. The apparatus according to claim 5 wherein said microcomputer is programmed to calculate an air velocity value at said sensing means from said velocity signal, said defrost initiation value corresponds to an air velocity and the defrost cycle initiation signal is generated when said calculated air velocity value does not exceed said defrost initiation value.

7. The apparatus according to claim 6 and further comprising printing means for printing said air velocity value at the velocity sensor calculated by said microcomputer.

8. The apparatus according to claim 7 and further comprising clock means, for generating a time value corresponding to said velocity value, said printing means printing said time value with said air velocity value.

* * * * *